United States Patent [19]

Miller et al.

[11] 4,232,417

[45] Nov. 11, 1980

[54] MARINE MAMMAL RETRIEVAL APPARATUS

[75] Inventors: Donald Miller, Del Mar; Robert W. Skipton, San Diego, both of Calif.

[73] Assignee: The United States of America as represented by the Secretary of the Navy, Washington, D.C.

[21] Appl. No.: 6,055

[22] Filed: Jan. 24, 1979

[51] Int. Cl.[3] ..... B63B 21/52; B63C 9/16

[52] U.S. Cl. ..... 9/8 R; 9/314; 73/170 A; 119/29

[58] Field of Search ..... 9/8 R, 9, 314, 315, 9/316, 318, 211; 119/29, 96, 130; 405/185, 186; 73/170 A

[56] References Cited

U.S. PATENT DOCUMENTS

| | | | |
|---|---|---|---|
| 1,694,714 | 12/1928 | Markus | 9/316 |
| 2,752,977 | 7/1956 | Clarke et al. | 9/11 A |
| 3,152,344 | 10/1964 | Radnofsk | 9/316 |
| 3,510,025 | 5/1970 | Turner, Jr. | 9/315 |
| 3,628,205 | 12/1971 | Starkey | 9/8 R |
| 3,753,422 | 8/1973 | Seiple | 119/29 |

FOREIGN PATENT DOCUMENTS

| | | | |
|---|---|---|---|
| 1557300 | 3/1968 | France | 9/314 |

*Primary Examiner*—Charles E. Frankfort

*Attorney, Agent, or Firm*—Richard S. Sciascia; Ervin F. Johnston

[57] ABSTRACT

An acquatic retrieval apparatus is provided which includes a flotation bag, a gas pressure bottle which is associated with the flotation bag for inflating the bag, a puncturing device connected to the pressure bottle for puncturing the bottle to let the pressurized gas into the bag, a timer connected to the puncturing device for activating the puncturing device so as to puncture the bottle after a predetermined time, and an on-off switch adapted to be connected to a power source for applying power to the timer when the switch is turned on.

9 Claims, 8 Drawing Figures

FIG. 1.
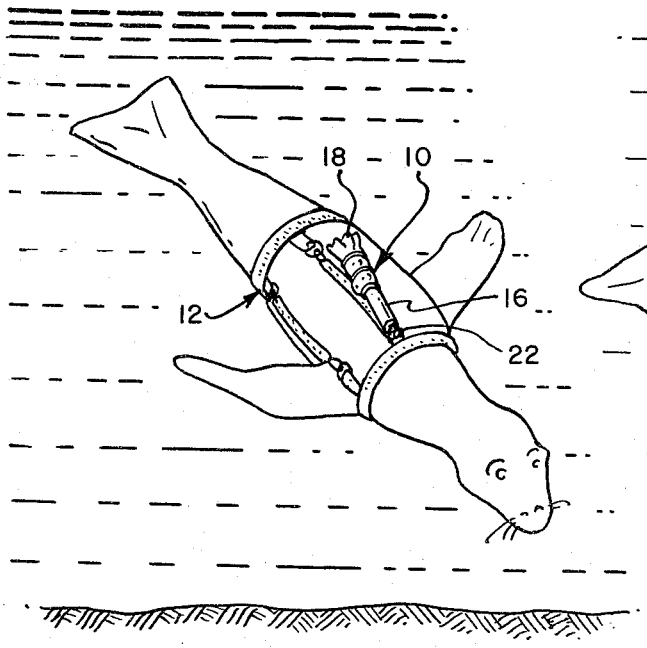
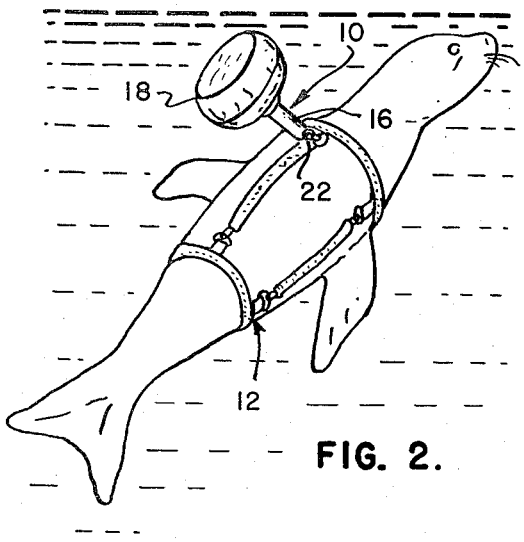
FIG. 2.
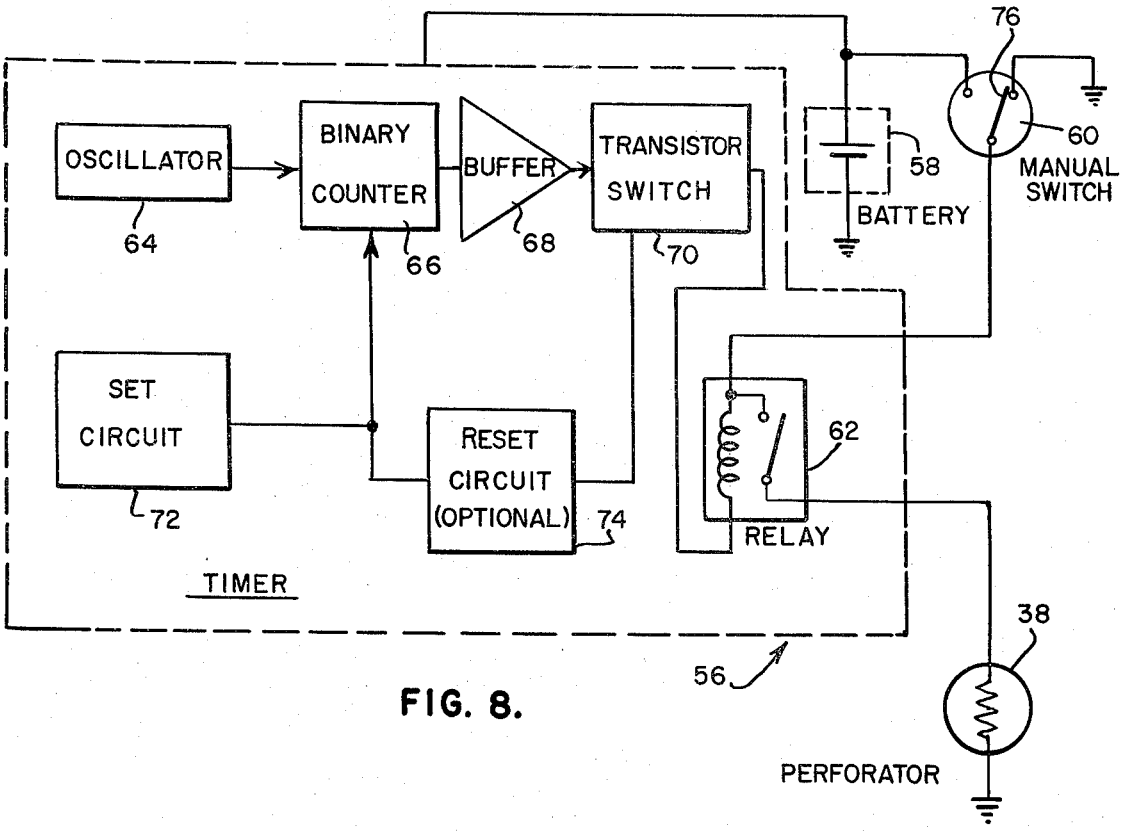
FIG. 8.

FIG. 3.
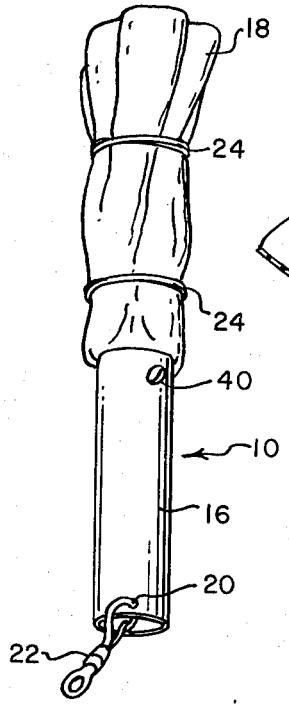
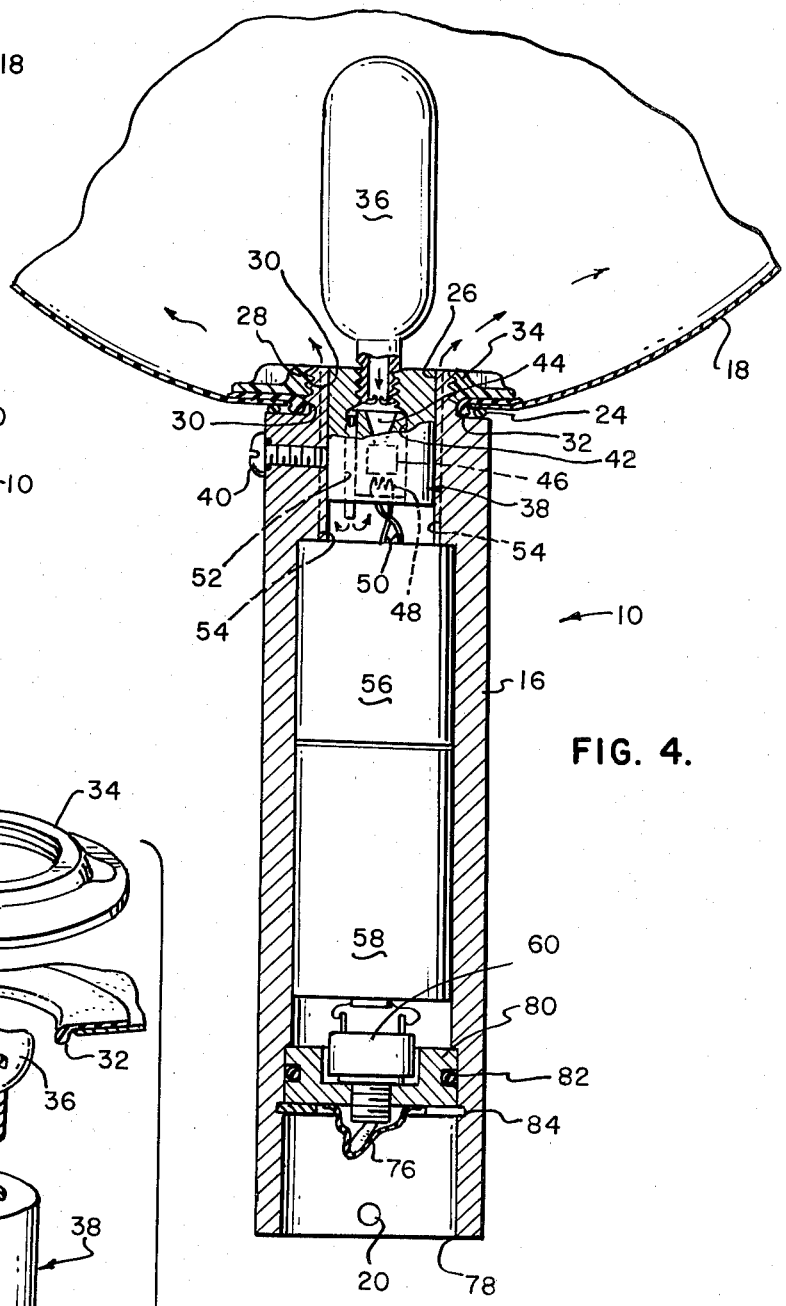
FIG. 4.
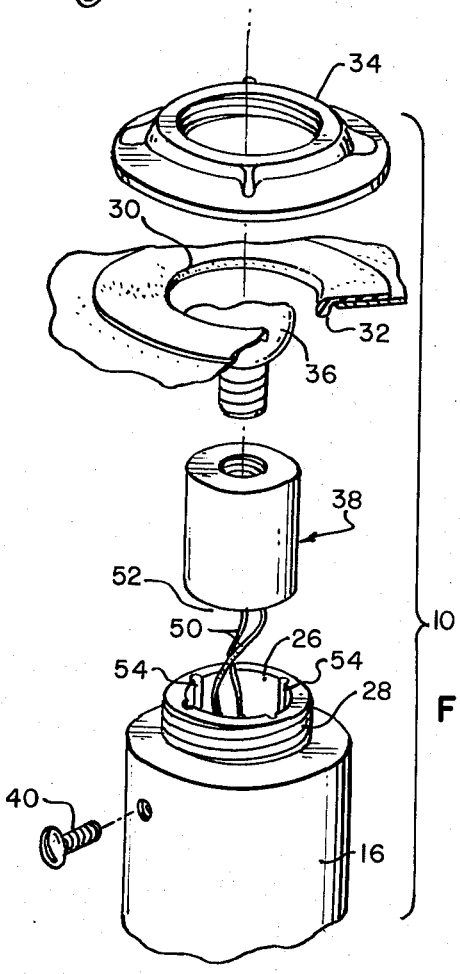
FIG. 5.

MARINE MAMMAL RETRIEVAL APPARATUS

BACKGROUND OF THE INVENTION

Marine mammals, such as seals, sea lions, or porpoise are being utilized to perform work functions in the ocean waters. These mammals have been utilized for enabling the retrieval of objects located on the ocean bottom. This has been accomplished by mounting a tethered device to the mammal which can be carried by the mammals to the object and clamped thereto, so that personnel on a surface ship can utilize the tether to retrieve the object. One of the problems with these marine mammals is that while performing the work function or while being trained to perform such work functions in the open ocean, they will decide to escape or will undertake a long hunting trip for food. The previous method of preventing such problems has been to attach a line to the mammal so that he can be returned to the trainers. However, this line has seriously encumbered the mammal's swimming ability, and also endangers the mammals life by the possibility of becoming entangled with underwater objects. A better way of ensuring the return of these worker mammals is needed.

SUMMARY OF THE INVENTION

The present invention provides an apparatus which can be attached to a marine mammal so as to ensure the recovery of the mammal after a predetermined length of time. This has been accomplished by providing an apparatus which has a flotation bag, a gas pressure bottle which is associated with the flotation bag for inflating the bag, a puncturing device connected to the pressure bottle for puncturing the bottle to let the pressurized gas into the bag, a timer connected to the puncturing device for activating the puncturing device so as to puncture the bottle after a predetermined time, and an on-off switch which is adapted to be connected to a power source for applying power to the timer when the switch is turned on. While the retrieval apparatus has been described for use with a marine mammal, it is to be understood that such apparatus can be used for other purposes, such as the return of oceanographic instrumentation after the instrumentation has been submerged for a predetermined time.

OBJECTS OF THE INVENTION

An object of the present invention is to provide a compact and efficient retrieval apparatus for applying positive buoyancy to a submerged object after a predetermined period of time.

Another object is to provide a compact package which can be attached to a marine mammal so as to ensure the return of the mammal to the surface of the water after a predetermined length of time.

A further object is to provide a marine mammal retrieval apparatus which can be reset automatically to repetitively ensure an automatic recovery of a marine mammal after a predetermined length of time.

Still another object is to provide an inflatable marine mammal retrieval apparatus which is simple to manufacture and can be easily operated on a repetitive basis.

These and other objects of the invention will become more readily apparent from the ensuing specification when taken together with the drawings.

DESCRIPTION OF THE DRAWINGS

FIG. 1 is an ocean elevation view of a marine mammal wearing the retrieval apparatus in a deflated condition.

FIG. 2 is an ocean elevation view of the marine mammal wearing the retrieval apparatus in an inflated condition.

FIG. 3 is a perspective view of one embodiment of the invention in a deflated condition.

FIG. 4 is a cross-sectional view of the embodiment illustrated in FIG. 3 with a portion of the inflatable bag illustrated in an inflating condition.

FIG. 5 is an exploded view of a top portion of the embodiment illustrated in FIG. 4.

FIG. 8 is a block diagram of an exemplary timing system for either of the embodiments of this invention.

DESCRIPTION OF THE PREFERRED EMBODIMENTS

Figure 6:
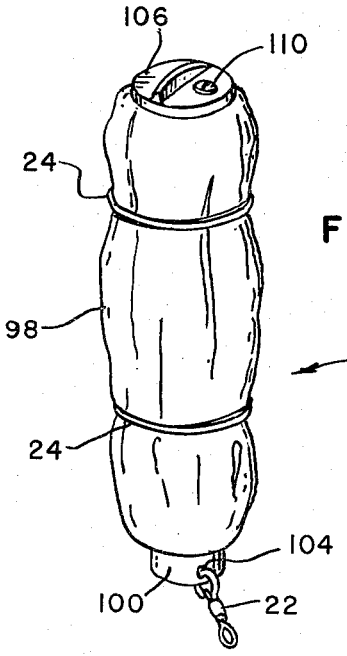
FIG. 6 is a perspective view of another embodiment of the invention shown in a deflated condition.
Figure 7:
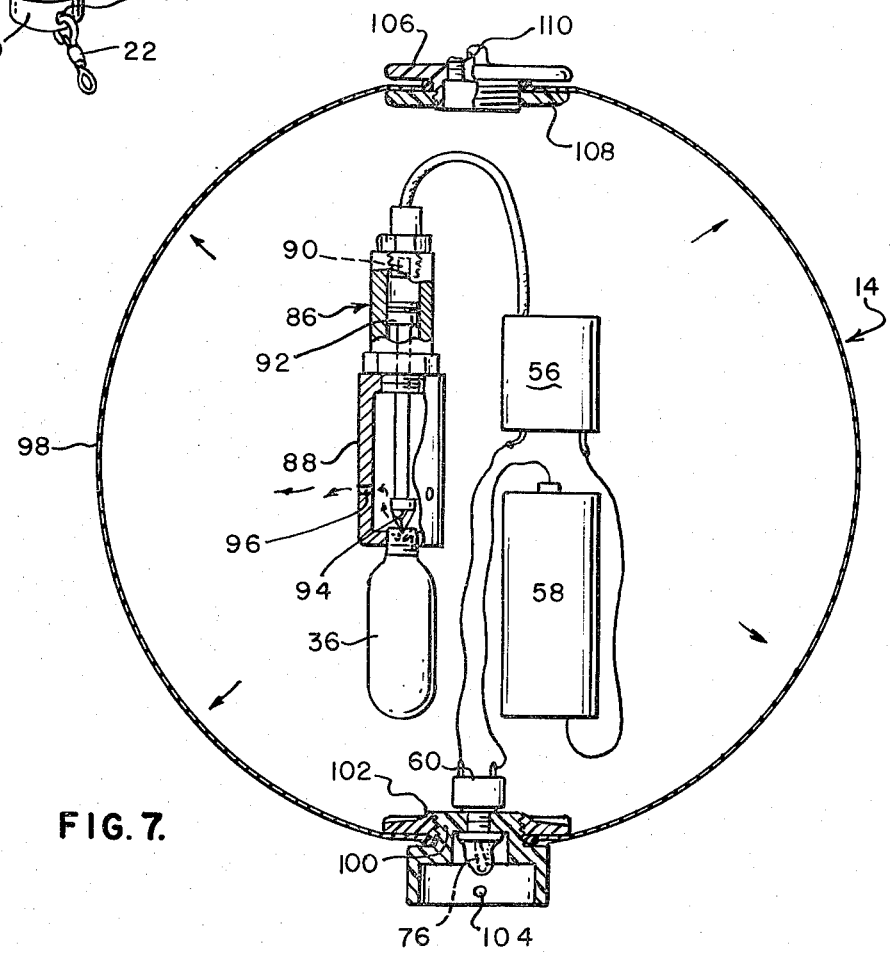
FIG. 7 is a schematic illustration of the embodiment of FIG. 6 in an inflated condition.

Referring now to the drawings wherein like reference numerals designate like or similar parts throughout the several views there is illustrated in FIG. 1 the retrieval apparatus 10 mounted to a seal by a harnass 12. In FIG. 1 the retrieval apparatus 10 is shown in a deflated condition so that the seal is free to swim unhampered to perform work functions within the ocean. After a predetermined period of time the retrieval apparatus 10 is activated to inflate and cause a positive buoyancy force on the seal. This operation is illustrated in FIG. 2 which causes the seal to gradually ascend to the surface of the ocean where the seal can be recovered. The retrieval apparatus 10, which is shown in detail in FIGS. 3 through 5 is one embodiment of the invention, and another embodiment 14 of the invention is illustrated in FIGS. 6 and 7.

As illustrated in FIG. 3, the retrieval apparatus 10 may include a pressure housing 16 and a flotation bag 18. The pressure housing 16 may be elongated with an aperture 20 in its bottom portion for the connection of a snap hook 22. The snap hook 22 in turn may be connected to the harnass 12 worn by the seal. The flotation bag is shown in a deflated folded condition with elastomeric straps, such as rubber bands 24 therearound to retain the flotation bag 18 in the folded condition until such time that the flotation bag 18 is inflated. When the flotation bag 18 is inflated the rubber bands 24 are simply forceably rolled off to allow the flotation bag to assume its fully expanded condition.

As illustrated in FIG. 4, the pressure housing 16 may be provided with a top opening 26, and the flotation bag 18 may be sealably mounted to the pressure housing opening 26 so that the interior of the bag is in communication with the interior of the pressure housing 16. This may be accomplished by providing the top portion of the pressure housing 16 with a reduced threaded portion 28, and providing the bag with an aperture 30 which will be received by the threaded portion 28. An O-ring 32 is provided between the bag 18 and the remaining shoulder of the pressure housing 16, and a nut 34 on the inside of the bag 18 is threaded onto the threaded portion 28 of the pressure housing to effect a seal by the O-ring 32 and to tightly retain the bag 18 to the pressure housing.

A gas pressure bottle means, such as a $CO_2$ bottle 36, is associated with the flotation bag 18 for inflating the bag when the $CO_2$ bottle is punctured. In the preferred embodiment the $CO_2$ bottle is located primarily within the bag 18 by a structure which will be explained hereinbelow.

As illustrated in FIGS. 4 and 5, means, such as a perforator 38, may be connected to the $CO_2$ bottle 36 for puncturing the bottle to let the pressurized gas into the bag. The perforator 38 is snugly fitted within the top portion of the pressure housing 16, and may be retained in place by a set screw 40. The pressure bottle 36 is held in its position by threading it into a top portion of the perforator 38. The perforator 38 is provided with a central bore 42 for the receipt of a shaped charge 44 and a detonator 46. The detonator 46 is activated by a resistance wire 48 embedded therein, and the resistance wire 48 is brought to detonation temperature by a source of current over a pair of wires 50. The detonator 46 fires the charge 44 which in turn punctures the $CO_2$ bottle 36. In order to provide an escape for the pressurized gas from the $CO_2$ bottle the perforator 38 is provided with a passageway 52 from the bottle to the bottom of the perforator where the gases are released. In order to channel the pressurized gas into the flotation bag 18 the interior top portion of the pressure housing 16 is provided with longitudinal passageways 54 which extend into the flotation bag 18. The aforementioned perforator 38 is obtainable from Jet Research Center, Inc., Arlington, Tex.

The wires 50 of the puncturing means 38 may be connected to a timer 56 which is capable of activating the puncturing means 38 after a predetermined period of time. A battery 58 may be mounted in the pressure housing 16 for providing a power source to the timer 56 and energizing the wires 50 therethrough, and an on-off switch 60 may be provided for switching the electrical power of the battery 58 to the timer 56. An exemplary circuit for the aforementioned components is illustrated in FIG. 8. As illustrated in FIG. 8, when the switch 60 is turned on, battery power is applied to a relay 62 and the remainder of the components within the timer 56. The remainder of the components in the timer 56 include a low frequency oscillator 64 which operates in the range of 50 to 60 Hertz. The oscillator 64 clocks a binary counter 66 which performs the timing function. A suitable type of counter is the 14 stage binary carry type (CD4020EE) made by RCA. The output of the counter goes through a buffer 68 into a "Darlington" type transistor switch 70. When triggered by the binary counter 66 the transistor switch 70 will close the circuit to the relay 62 to cause this relay to actuate the perforator 38. A set circuit 72 may be connected to the binary counter 66 to make sure that the timer starts at zero when power is applied to the timer 56. Further, a reset circuit 74 may be connected to the binary counter for setting the counter back to zero when the relay 62 has been closed after the preset predetermined length of time. The binary counter 66 determines the predetermined length of time and can be adjusted as desired.

As illustrated in FIG. 4, the switch 60 may be mounted through the housing 16 with a manual actuator 76 located exteriorly thereof. In the preferred embodiment the switch 60 is mounted in a bottom portion of the pressure housing 16 a distance upwardly from a bottom open end 78 thereof. The switch 60 may be threaded into a plug 80 which in turn is sealed to the interior wall of the pressure housing by an O-ring 82. The plug 80 may be held in place by a retainer ring 84.

In the preferred embodiment illustrated in FIGS. 3 through 5 the perforator 38, the timer 56, the battery 58, and the switch 60 are mounted within the pressure housing 16. As explained hereinabove the $CO_2$ bottle is preferably mounted within the flotation bag 18. The flotation bag 18 can then be folded about the $CO_2$ bottle in a deflated condition and wrapped with rubber bands 24 which will slip off the flotation bag 18 when it is inflated by the puncturing of the $CO_2$ bottle.

The other embodiment 14 of the present invention is illustrated in FIGS. 6 and 7. In this embodiment a thruster 86 has been utilized in lieu of the perforator 38 as a puncturing means for the $CO_2$ bottle 36. It has been found satisfactory to utilize a Model 2900 linear actuator made by Holex for the thruster 86. The thruster 86 is threaded into a pressure manifold 88 which is in turn threaded to the $CO_2$ bottle 36. As illustrated in FIG. 7, the thruster 86 has a charge 90 which is exploded by the electrical current applied to the wires entering therein. The explosive force of the charge 90 drives a piston 92 which in turn forces a spike 94 with channel into the $CO_2$ bottle 36. The pressure manifold 88 has apertures 96 which allow the pressurized gas to escape into the flotation bag 98.

The significant difference of the embodiment 14 over the previously described embodiment is that the $CO_2$ bottle 36, the manifold 88, the thruster 86, the timer 56, and the battery 58 are all mounted within the flotation bag 98. The switch 60 is threaded into a plug 100 which in turn is threaded into a flange 102 in the bottom of the flotation bag. The plug 100 may be provided with a rim which has an aperture 104 for receiving the snap for connecting the apparatus to the harnass of a marine mammal. For assembly and operational purposes the top of the flotation bag is provided with a large plug 106 which is threaded into a flange 108 in the flotation bag. A smaller plug 110 may be threaded into the large plug 106 for removing the gas within the flotation bag 98 when it is desired to fold the bag about the interior components. When the bag 98 is folded about the interior components it may be wrapped with rubber bands 24 similar to the first mentioned embodiment. These rubber bands will slip off of the bag when the $CO_2$ bottle 36 is punctured to discharge gas within the flotation bag 98.

Obviously, many modifications and variations of the present invention are possible in the light of the above teachings, and, it is therefore understood that within the scope of the disclosed inventive concept, the invention may be practiced otherwise than specifically described.

What is claimed is:

1. A retrieval apparatus comprising:

a flotation bag;

gas pressure bottle means;

explosive means connected to the pressure bottle means for puncturing the bottle means;

electronically operated timing means connected to the puncturing means for activating the puncturing means so as to puncture the bottle means after a predetermined time;

a power source;

an on-off switch adapted to be connected to the power source for applying power to the timing means when the switch is turned on;

an elongated pressure housing which has a top opening at one end;

the puncturing means, timing means, power source, and on-off switch being mounted within the housing;

the flotation bag being sealably mounted to the pressure housing opening so that the interior of the bag is in communication with the interior of the housing;

the pressure bottle means extending from the top opening into the flotation bag; and the switch being mounted through the housing and having a manual actuator located exteriorly thereof.

2. An apparatus as claimed in claim 1 wherein the puncturing means includes:

a resistance wire connected to the timing means for activation thereby;

a detonator mounted in proximity to the resistance wire for detonation when the resistance wire is activated; and a shaped charge mounted in proximity to the detonator and the bottle means for exploding when the detonator is detonated and puncturing the bottle means during said explosion.

3. An apparatus as claimed in claim 2 including:

a plug;

the bottle being threaded in one end of the plug and the resistance wire, detonator, and shaped charge being located within the plug;

the plug being mounted within the top end of the pressure housing; and the plug and the pressure housing having passageway means for communicating gas from the bottle means to the flotation bag.

4. An apparatus as claimed in claim 3 including:

the flotation bag being folded about the pressure bottle means in a deflated condition; and an elastomeric strap resiliently holding the flotation bag in the folded condition.

5. An apparatus as claimed in claim 4 including:

the timing means including means for electronically resetting the timing means to zero when the switch is turned to an on position.

6. A retrieval apparatus comprising:

a flotation bag;

gas pressure bottle means;

explosive means connected to the pressure bottle means for puncturing the bottle means;

electronically operated timing means connected to the puncturing means for activating the puncturing means so as to puncture the bottle means after a predetermined time;

a power source;

an on-off switch adapted to be connected to the power source for applying power to the timing means when the switch is turned on; and the gas pressure bottle means, the puncturing means, the timing means, and the power source being mounted entirely within the flotation bag.

7. An apparatus as claimed in claim 6 including:

a pair of removable plugs mounted through the flotation bag; and the switch being mounted through one of the plugs and having a manual actuator which is located exterior of the flotation bag.

8. An apparatus as claimed in claim 7 including:

the flotation bag being deflated and folded about the gas pressure bottle means, the puncturing means, the timing means, and the power source; and an elastomeric strap resiliently holding the flotation bag in the folded condition.

9. An apparatus as claimed in claim 8 wherein the puncturing means includes:

a spike for puncturing the bottle;

a piston and cylinder with the spike connected to the piston; and a gas producing charge operably connected to the timing means and mounted within the cylinder for driving the piston and thrusting the spike into the bottle.

* * * * *